US007585136B2

(12) United States Patent
Biserna et al.

(10) Patent No.: US 7,585,136 B2
(45) Date of Patent: Sep. 8, 2009

(54) METHOD AND EQUIPMENT FOR MAKING AN IMPERMEABLE DIAPHRAGM OF SECANT PILES

(75) Inventors: Ezio Biserna, Budio di Longiano (IT); Maurizio Siepi, Cesena (IT)

(73) Assignee: Soilmec S.p.A., Cesena (FC) (IT)

( * ) Notice: Subject to any disclaimer, the term of this patent is extended or adjusted under 35 U.S.C. 154(b) by 281 days.

(21) Appl. No.: 11/540,135

(22) Filed: Sep. 28, 2006

(65) Prior Publication Data

US 2007/0105405 A1 May 10, 2007

(51) Int. Cl.
*E02D 5/18* (2006.01)

(52) U.S. Cl. ..... 405/267; 405/233

(58) Field of Classification Search ..... 405/231, 405/232, 233, 245, 267, 270
See application file for complete search history.

(56) References Cited

U.S. PATENT DOCUMENTS 1,665,798 A * 4/1928 Sipe ..... 405/267
3,839,871 A * 10/1974 Dyer et al. ..... 405/267
4,906,142 A * 3/1990 Taki et al. ..... 405/267
5,575,345 A * 11/1996 Shibasaki et al. ..... 405/267
5,758,993 A * 6/1998 Schmednecht et al. ..... 405/267
6,749,372 B2 * 6/2004 Xie ..... 405/267

* cited by examiner

*Primary Examiner*—Frederick L Lagman
(74) *Attorney, Agent, or Firm*—Merchant & Gould P.C.

(57) ABSTRACT

Described herein is a method and equipment for making an impermeable diaphragm of secant piles, based upon the execution of parallel holes with constant distances between centres, said method and equipment being of the type that uses a drill rod (5) equipped, at the bottom end, with a bit (16) for making adjacent holes (1, 1', 2) of substantially circular cross section, in which the equipment is constituted by a guide (6, 7), constrained to the drill rod (5), and made up of two elements shaped so as to press against the walls of two adjacent holes (1, 2); the two elements are connected to one another through a slider (20) passing through a vertical opening (21) made between the two holes (1, 2).

14 Claims, 2 Drawing Sheets

METHOD AND EQUIPMENT FOR MAKING AN IMPERMEABLE DIAPHRAGM OF SECANT PILES

BACKGROUND OF THE INVENTION

The subject of the invention is a method and equipment for making an impermeable diaphragm of secant piles.

In the dam-building sector, there is at present very sharply felt the problem of impermeabilization both of the dam itself and of the underlying terrain, as well as of the area of transition or toe. In particular, there are recurrent problems on dams during their operation: there exist dams that after some decades require interventions of restoration.

SUMMARY OF THE INVENTION

Intervention consists in general in traversing the body of the dam with a system of contiguous excavations that are sufficiently deep to reach impermeable layers of the terrain or bedrock, and in filling said excavations with a material that consolidates, reaching a high degree of impermeability and a good adhesion to the walls of the excavation. In general, recourse is had to concrete or plastic concrete.

The excavations can have a rectangular cross section (diaphragm panels) or drillings with circular cross section made in arrays and partially overlapping in plan view (secant piles). The former have a limit in depth linked to the availability of suitable equipment (60-70 m in all); the latter, as the diameter decreases, can abundantly exceed 100 m.

The problem, especially in the latter case and to an increasing extent as the diameter decreases, is how to guarantee the overlapping between one hole and the next. In fact, the flexibility of the drill rods, the proximity to previously existing holes, and the lack of uniformity of the terrain favour deviations from the vertical of the hole that is being drilled.

One solution that is adopted is to use a guide structure (vertical beam with rail) inserted and anchored in a hole that passes through the entire depth, on which a slide constrained to the drilling bits of the rods that carry out the next drilling operation is made to slide. The constraint is such as to enable rotation of the rod and of the bit.

It may readily be understood that the depth to be reached conditions the construction of this guide structure, which will be complicated by the need for dismantling and anchorage to the hole. Hence the practicality and the convenience of use decrease as the depth increases and occasions the need for a better solution.

BRIEF DESCRIPTION OF THE DRAWINGS

The invention will now be described with reference to the attached plate of drawings, in which:

FIG. 1 shows three adjacent holes, of which the two holes designated by 1 and 1' are already completed, whilst the hole designated by 2 is the one in which the excavation is being made using the drill rod 5.

The reference numbers 3 and 4 designate the surface portions of the walls of the holes 2 and 1, on which the equipment according to the invention, constituted by a guide divided into two parts 6 and 7 slides.

DETAILED DESCRIPTION OF THE PREFERRED EMBODIMENT(S)

Figure 1:
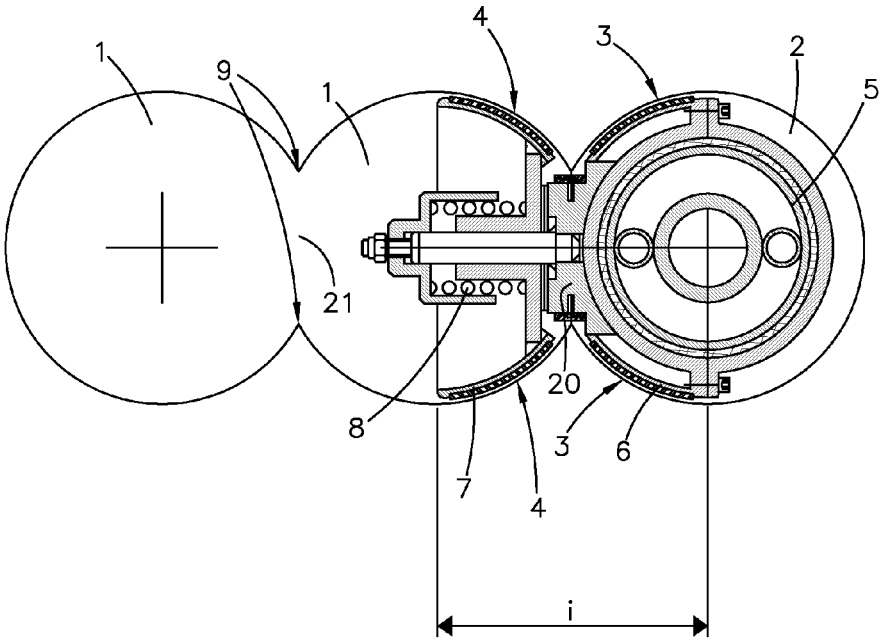
FIG. 1 shows, in plan view, a series of secant excavations, along with the equipment according to the invention.

According to the embodiment of FIG. 1, the two elements 6, 7 are connected to one another through a slider (20) passing through a vertical opening (21) made between the two holes (1, 2) and are pushed to one another through elastic means 8 that tend to bring them closer to one another, keeping them in contact against said walls of the two holes 1, 2 towards the cusps 9 made in a position corresponding to the opening 21.

By "i" in FIG. 1 is indicated the distance between the centres of the holes, which usually has a constant value for all the holes that are made to obtain the diaphragm.

The two parts 6 and 7 may be separated in order to modify the distance between centres, where required.

Figure 2A:
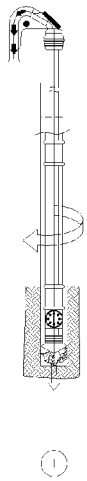
FIG. 2A-2H show, in front view and in plan view, each of the sequences of steps of excavation and of filling of a diaphragm obtained with the method and with the equipment according to the invention.
Figure 2B:
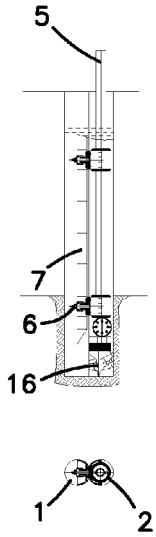

The guide element made up of the two parts 6 and 7, as may be noted in FIG. 2B, is connected to the drill rods 5 in the proximity of the bottom end or the bit 16. Said guide element does not require a rail or a metal guiding structure, but slides on part of the internal surface of the excavation being made and of the adjacent or preceding one (areas 3 and 4 of the holes 1 and 2 of FIG. 1).

In this way, the guide structure is eliminated, along with its problems of length, assembly, and fixing to the hole. The times involved and the difficulties of operation are markedly reduced with the elimination of the step of assembly, positioning, and fixing of the guide structure.

It is clear that the two parts 6 and 7 of the guide element may also have other configurations, provided that they are suitable for resting against the walls of the holes in which they are inserted, albeit not reproducing them perfectly.

Furthermore, the springs 8 may not be present if it is deemed that the adhesion of the parts 6 and 7 can in any case be guaranteed.

Finally, the position of the springs 8 may indifferently be either on the part of guide 6 carried by the rod 5, which thus becomes the mobile one, or else on the part of guide 7, as may be noted in the solution of FIG. 1.

The springs 8 can also be replaced by spacers of variable length that have the job of modifying the distance between centres of the guides.

The system is suited to terrains and materials of construction of the dam that are sufficiently stable and solid to guarantee a resistance and continuity of the walls of the hole throughout its depth. For example, the system is not deemed suitable for dams in soil and for soft terrains (Dutch dams).

The method consists in the execution of a first hole by means of a traditional drill rod shown in FIG. 2A, with all the necessary measures taken for obtaining the best verticality (piloted holes, inclinometric controls, inverted pendulum, etc.).

The first hole is used as reference for drilling the second hole adjacent to the first shown in FIG. 2B using the guide 6, 7 described above. Even if the hole were not vertical, the constancy of distance between centres I with the preceding one is even so guaranteed. The first two holes 1 and 1' illustrated on the left in FIG. 1 are thus obtained.

Figure 2C:
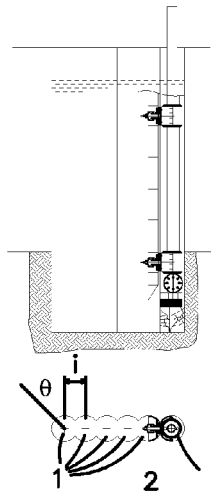

In sequence, it is possible to make a first array of holes shown in FIG. 2C before filling them. In general, it will be necessary to avoid making arrays that are too extensive, which could undermine the stability of the dam.

The type of drilling to be adopted is preferably the one with removal of detritus by circulation of mud, in particular what is known as mud flush drilling. In this method, as the holes are made, they are all kept full of drilling mud for balancing the thrusts of the terrain. This drilling mud is sucked up through the rods and draws along with it the detritus excavated by the bit, then unloading it on the surface, usually in a settling tank. The desanded fluid can be re-used for the excavation.

Since the aspiration of the detritus is made through the bit, possible detritus present in the adjacent excavations is free to collapse towards the lowest point and is in this way sucked up by the excavating tool.

As an alternative to mud flush drilling, the extraction of the detritus can be performed separately with known means, such as submersed pumps or air-lift pumps.

The guide element 6-7 is of modest length if compared to the depth of excavation and is positioned above the bit 16, at a distance such as not to be hindered in its descent by possible detritus that is found in the adjacent hole and to enable the detritus to flow away towards the suction mouth.

For the step of filling, the method envisages that the aggregating material is poured using the traditional "contractor" system in a certain number of holes of the array. The purpose is, on the one hand, to economize by not repeating this operation too frequently, and, on the other, not to leave an array of holes that is too extensive and for an excessively long time, factors that increase the temporary weakening of the dam.

In order to leave free the last hole made 12 to guide the subsequent one upon resumption of the array, the filling of the array itself will have to be limited to the next-to-last hole 10. The method then envisages that into the next-to-last hole 10 there will be lowered a sealing member 11 shown in FIG. 2D.

In the preferred, albeit not binding, option, it is envisaged to lower into the hole a pipe 11 made of plastic material sufficiently deformable under the lateral thrusts so as to rest on the walls of the hole and provide a seal. It is to be filled first with concrete as shown in FIG. 2E so as to ensure the conservation of its circular shape. As may be noted, as the hole 10 is filled with concrete, the drilling mud that filled the hole itself flows away or overflows into the adjacent holes according to the casting method used.

Figure 2D:
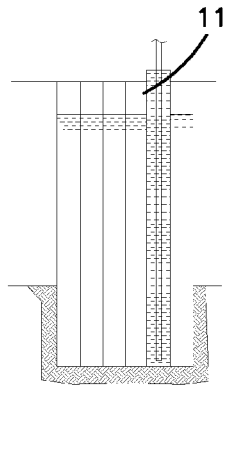
Figure 2E:
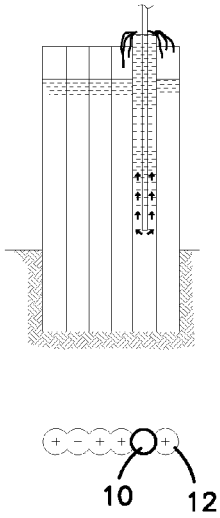
Figure 2F:
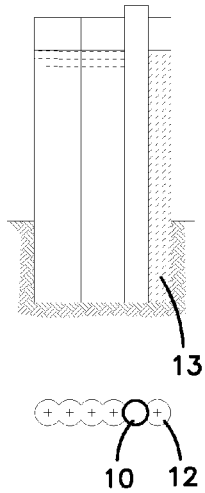
Figure 2G:
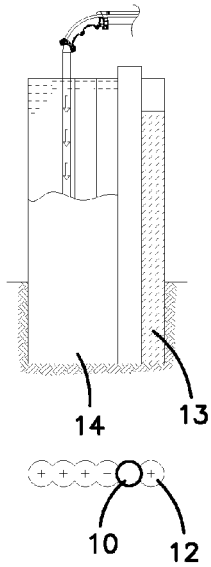

The last hole 12 must then be filled as shown in FIG. 2F with sand 13, in order to limit the effect of possible concrete that diffuses in this direction from the adjacent hole 10. To finish, filling of the array of preceding holes is then carried out with concrete 14, as shown in FIG. 2G, so that the pipe is pushed against the last pair of cusps, thus providing a sufficient seal.

Figure 2H:
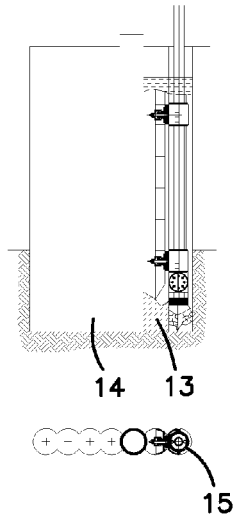

When the drillings 15 are resumed, as shown in FIG. 2H, the sand 13 of the last hole 12 will be sucked up along with the detritus of the hole being made.

As an alternative, the sealing member could be a bag made of suitable material (e.g., woven fabric) to be ballasted and lowered into the excavation provided and then be filled with incoherent materials, sand or gravel. In this case, there is envisaged final saturation of the sand or gravel with a grout-injection pipe, through which to carry out a pressurized pumping of cement grout.

Another variant is the provisional filling of the last excavation 12, instead of the next-to-last one 10, with a means that can be completely demolished and removed in the step of execution of the first hole of the next array. In this case, a bag is required, the fibres of which do not interfere with the work of excavation of the bit, or else a pipe made of relatively brittle material, such as for example PVC. The gravel or sand must be free to flow away towards the excavation mouth.

A further variant for carrying out casting of a first sequence of holes and starting the next sequence consists in laying at the centre of the last hole 12, with appropriate centring means, a pipe made of material that can easily be demolished, in a way similar to what is envisaged in FIG. 2D in the next-to-last hole 10.

In a way similar to the step shown in FIG. 2G, the subsequent casting of concrete will fill all the holes except for the inside of the aforesaid pipe.

The first hole of the next series consists in a drilling operation to widen the hole, said operation being governed by the pipe made of brittle material, made without any lateral guide and with a pilot tip inserted in the aforesaid pipe.

Next, the holes of the new series are made with the guide device that forms the subject of the present invention.

Finally, it may be noted that for certain applications it may be useful to have a guide 6, 7 of variable length; consequently, this may also be of the telescopic type, i.e., made up of a number of tubes inserted in one another in such a way that they can be slid in and out in a controlled way by means of appropriate mechanical or electrical means.

The invention claimed is:

1. Equipment for making an impermeable diaphragm of secant piles, wherein the holes are made parallel with generally constant distances between centers; said equipment comprising:

a drill rod having a bottom end, a bit at the bottom end of the drill rod for making adjacent holes of substantially circular cross section, a guide constrained to the drill rod, and having two elements shaped so as to be guided on the walls of two adjacent holes; the two elements that form the guide being connected to one another.

2. The equipment according to claim 1, wherein the two elements are connected to one another through a slider passing through a vertical opening made between the two holes.

3. The equipment according to claim 1 wherein the two elements are shaped like the arc of a circumference so as to reproduce the walls of the two holes in which they are respectively inserted.

4. The equipment according to claim 1, wherein the two elements are connected to one another through elastic means biasing the two elements toward one another, keeping them in contact against said walls of the two holes towards cusps made in a position corresponding to the opening.

5. The equipment according to claim 4, wherein one element is carried by the rod and is fixed to the slider, wherein the other is connected to the slider through said elastic means.

6. The equipment according to claim 1, wherein the guide is fixed to the drill rod in the proximity of the bit.

7. A method for making an array of secant bores forming an impermeable diaphragm, based upon the execution of parallel holes with constant distances between center, obtained by a mechanical guiding device, a drill rod having a bottom end, a bit at the bottom end of the drill rod for making adjacent holes of substantially circular cross section, a guide constrained to the drill rod, and having two elements shaped so as to be guided on the walls of two adjacent holes; the two elements that form the guide being connected to one another; said method comprising the following steps:

creating a first hole by a drill rod;

creating an array of holes adjacent to the first hole and to one another by use of said guiding equipment inserted between a last hole made and the one being made.

8. The method according to claim 7, further comprising a step of provisional filling of the last hole or of a next-to-last hole of the array with material for containment to enable prosecution of the array of holes at a later date; and a subsequent step of filling with concrete the array of holes that precede the one filled in a provisional way.

9. The method according to claim 7, wherein a sealing member is lowered into the next-to-last hole and is filled with said filling material, wherein the last hole is filled with material that can be easily removed, wherein when drilling of the holes is resumed, the easily removable material of the last hole and the detritus of the hole being made are sucked up.

10. The method according to claim 9, wherein the sealing member is a pipe filled with concrete, removing the provisional filling material.

11. The method according to claim 9, wherein the sealing member is a ballasted bag filled or saturated with incoherent material after being inserted into the next-to-last hole.

12. The method according to claim 8, wherein the provisional hole is the last one and the provisional filling is made with a material that can be completely demolished and removed in the step of execution of the first hole of the subsequent array.

13. The method according to claim 7, wherein a pipe made of material that can easily be demolished is laid at the center of the last hole; the next casting of concrete filling all the holes except for the inside of said pipe; the first hole of the next series comprising drilling for widening the hole, said drilling being piloted by the pipe made of brittle material.

14. The method according to claim 12, wherein the material is contained in a bag inserted into the hole.

* * * * *